US006184825B1

(12) United States Patent
Wehner et al.

(10) Patent No.: US 6,184,825 B1
(45) Date of Patent: Feb. 6, 2001

(54) METHOD AND APPARATUS FOR RADIO FREQUENCY BEAM POINTING

(75) Inventors: James W. Wehner, Torrance; Richard B. Sherwood, Palos Verdes Estates; Edward J. Simmons, Jr., Cypress, all of CA (US)

(73) Assignee: TRW Inc., Redondo Beach, CA (US)

( * ) Notice: Under 35 U.S.C. 154(b), the term of this patent shall be extended for 0 days.

(21) Appl. No.: 09/342,369

(22) Filed: Jun. 29, 1999

(51) Int. Cl.[7] ..... H01Q 3/00
(52) U.S. Cl. ..... 342/359; 342/77; 342/357.11
(58) Field of Search ..... 342/75, 77, 354, 342/357.11, 359, 462

(56) References Cited

U.S. PATENT DOCUMENTS 4,030,099 * 6/1977 Valenti et al. ..... 343/117 R
5,485,156 * 1/1996 Menseur et al. ..... 342/77
5,556,058 * 9/1996 Bender ..... 244/171

* cited by examiner

*Primary Examiner*—Thomas H. Tarcza
*Assistant Examiner*—Dao L. Phan
(74) *Attorney, Agent, or Firm*—Michael S. Yatsko

(57) ABSTRACT

An RF beam pointing apparatus (500, 600) compensates for the effects of settling errors on antenna pointing. The beam pointing apparatus includes an attitude reference system (502, 528, 530, 534) generating an antenna attitude output from the satellite attitude. Also included is attitude comparison circuitry (528, 530), coupled to the attitude reference system, that includes an antenna pointing error output. Control circuitry (528, 530) is coupled to the attitude reference system (502, 528, 530, 534) and the attitude comparison circuitry (528, 530). The control circuitry (528,530) directs the attitude comparison circuitry (528, 530) to generate control error output signals in response to dynamic settling antenna pointing errors induced by a mechanical slew on the satellite. An electronic beam pointing system (500, 600) is provided to steer the antenna (544) in response to the antenna pointing error signals to reduce the dynamic settling antenna pointing errors to within a predetermined pointing accuracy for nominal operation (202).

28 Claims, 8 Drawing Sheets

Pointing Error During and After Slew for
a Body Slewed Space Based Radar

Slew Angle Profile for a Body Slewed Space Based Radar

METHOD AND APPARATUS FOR RADIO FREQUENCY BEAM POINTING

BACKGROUND OF THE INVENTION

The present invention relates to satellite radio frequency (RF) beam pointing. In particular, the present invention relates to integrating mechanical and electronic beam pointing in a feedback controlled beam pointing method and apparatus.

Satellites use RF beam pointing techniques to point an antenna at terrestrial and space based targets. The targets may be of interest for space/ground communication, space/space intersatellite links, and for radar beam directed imaging, as examples. Two beam pointing techniques are commonly used: mechanical beam pointing and electronic beam pointing.

Mechanical beam pointing involves mechanically moving or slewing a satellite, or individual antennas on the satellite, to direct the beam generated by the antenna to a particular target. Mechanical pointing can be cost effective for certain applications, but often body and antenna dynamics can result in low to moderate slew rates.

Moreover, because satellites are not perfect rigid bodies, the satellite may take a significant amount of time to dynamically settle, during which beam pointing is relatively inaccurate. Therefore, during the time it takes the satellite and its components to settle, the system is generally non-operational or suffers significant performance degradation. As a general rule for radar satellite imaging systems, imaging is suspended until the pointing error due to dynamic settling of the satellite reaches 1/10 or 1/20 of a beamwidth or less.

Referring now to FIG. 1, the target access regions 102, 104 for a typical synthetic aperture radar ("SAR") imaging satellite are shown. A SAR system relies on relative motion to increase its effective imaging aperture and therefore has difficulties imaging directly below, directly in front, or directly behind the direction of flight. Attenuation and power constraints limit imaging at long distances, near the Earth limb. The result is a "butterfly" instantaneous imaging field-of-regard ("FOR"). In FIG. 1, the FOR is assumed constrained by a 70 degree ground elevation angle (GEA) 106 and a 20 degree GEA 108.

The satellite direction of travel 110 and apparent target motion 112 are also shown.

The target must remain inside the FOR for the duration of the image. Orbits with relatively low altitudes are often desired to reduce radar power, but these orbits also result in rapid (approximately 7 km/sec) relative satellite motion with respect to the ground targets, such that targets remain inside the FOR for relatively short durations (for example, less that one minute). Because multiple targets are often of interest inside the FOR, there is a strong motivation to image each target as quickly as possible.

As will be explained in more detail below with regard to FIGS. 2 and 3, however, mechanical slew induced settling errors prevent the satellite from accurately imaging the target for significant amounts of time. The resolution of each target, the total number of targets that may be imaged in a FOR, and the overall effectiveness of the radar imaging system are correspondingly reduced.

FIG. 2 shows a position error profile 200 for a computer simulation of a mechanical RF beam pointing system used on board a low earth orbit ("LEO") satellite. The position error profile 200 results from the mechanical slew angle profile 300 shown in FIG. 3. The simulation represented in FIG. 3 assumes a RF beamwidth of approximately 0.2 degrees and a 12 second simulated mechanical satellite body slew (beginning at t=0) of 90 degrees to adjust the attitude of the satellite and its rigidly mounted antenna. The settling time required before the pointing accuracy required for nominal operation (approximately 0.01 degree–0.02 degree as indicated by reference numeral 202) was reached was approximately sixteen seconds (from t=12 to approximately t=28).

Thus a significant fraction of the overall available satellite time must be spent waiting for the satellite to slew and settle before capturing images. Unfortunately, precise mechanical pointing with rapid settling is extremely expensive and extremely difficult to implement.

The long slew times and long settling times associated with mechanical pointing systems are not present in electronic pointing systems. Moreover, electronic pointing systems are often more accurate than mechanical pointing systems because jitter and body dynamics associated with mechanical pointing and control hardware are not experienced. However, eliminating all mechanical pointing through the implementation of a broad angle two dimensional (e.g, steerable in azimuth and elevation) phased array is extremely costly and complex.

Primarily, broad angle two dimensional electronic beam pointing is prohibitively expensive because it requires a great number of variable time delay transmit/receive ("TR") modules and RF radiating and receive elements closely spaced together. Furthermore, physical constraints on TR module separation may also limit angular coverage. Another significant drawback of a broad angle two dimensional electronic beam pointing system is the increased backend signal generation and signal processing complexity (as well as increased system power and weight) required to properly operate the two dimension phase array.

Radar is only one example of an application adversely effected by settling errors. As another example, communications applications also suffer from mechanical slew induced settling errors. Because reliable communication requires accurate alignment of transmit and receive antennas, antenna mispointing resulting from settling errors may compromise, as examples, the length of time two entities may communicate, the reliability of the communication, or the rate of communication.

A need has long existed in the industry for a method and apparatus for RF beam pointing with the low cost, broad area coverage features of mechanical pointing and the high accuracy, rapid pointing capability of electronic beam steering.

BRIEF SUMMARY OF THE INVENTION

It is an object of the invention to provide an improved RF beam pointing apparatus and method.

It is an additional object of the invention to provide a method and apparatus for beam pointing with the low cost and broad area coverage features of mechanical pointing and the high accuracy and rapid pointing capability of electronic RF beam pointing.

It is a further object of the invention to provide a feedback controlled apparatus and method for RF beam pointing.

It is a still further object of the invention to provide a RF beam pointing apparatus and method for use with transmit only, receive only, or transmit and receive radar and communications applications.

One or more of the foregoing objects are met in whole or in part by the present invention which provides a method and apparatus for compensating for the effects of mechanical slew induced dynamic settling errors on antenna pointing. A mechanical slew first occurs on a satellite carrying an antenna electronically steerable in at least one dimension. The antenna may be a phased array antenna, for example, and the mechanical slew may be a mechanical pointing maneuver of the satellite itself (e.g., a body slew using thrusters) or the antenna itself (e.g., by actuating antenna mounted gimbals). In response to dynamic settling antenna pointing errors resulting from the mechanical slew, the method performs electronic attitude correction. The mechanical slew thus provides coarse broad area pointing while the electronic attitude correction provides precise, narrow angle, rapid pointing.

The electronic attitude correction includes determining antenna attitude based on a current satellite attitude provided by a satellite attitude reference system, comparing the current antenna attitude to a desired antenna attitude, and electronically steering the antenna toward the desired antenna attitude. The dynamic settling induced antenna pointing errors are thereby reduced to within a predetermined pointing accuracy for nominal operation almost immediately after the mechanical slew is complete.

The method may, for example, operate during a target tracking sequence and, concurrently with the electronic attitude correction, additionally perform mechanical attitude correction to track the target. As with the electronic attitude correction, the mechanical attitude correction may proceed by determining the antenna attitude from a current satellite attitude using the satellite attitude reference system, comparing the current antenna attitude to the desired antenna attitude, and mechanically steering the antenna toward the desired antenna attitude. Typically, the mechanical attitude correction proceeds at a much slower rate than the electronic attitude correction. As examples only, the electronic attitude correction may proceed at approximately 1000 Hz or more, while the mechanical attitude correction may proceed at approximately 100 Hz or less.

The antenna may be used as a transmit only, a receive only, or a transmit and receive antenna. The antenna may be used in virtually any type of application, including, for example, communications and RADAR applications. It is further noted that the electronic attitude correction may continue beyond the time during which the mechanical slewing induced settling errors die out (e.g., beyond time t=28 in FIG. 2). In other words, the present method may be used to provide continued compensation for any additional errors in pointing from other sources.

The present invention also resides in an RF beam pointing apparatus that compensates for the effects of settling errors on antenna pointing. The beam pointing apparatus includes an attitude reference system generating an antenna attitude output based on the current satellite attitude determined by the attitude reference system. Also included is attitude comparison circuitry, coupled to or part of the attitude reference system.

Control circuitry (for example, part of an on-board computer) is coupled to or is part of the attitude reference system and the attitude comparison circuitry. The control circuitry directs the attitude comparison circuitry to generate attitude control error signals in response to dynamic settling antenna pointing errors induced by a mechanical slew on the satellite. An electronic beam pointing system is provided to steer the antenna in response to the attitude control error signals to reduce the dynamic settling antenna pointing errors to within a predetermined pointing accuracy for nominal operation.

The attitude reference system may accept input from, for example, a star tracker, a sun sensor or an inertial reference unit. The electronic beam pointing system typically includes variable time delay modules for steering the antenna in azimuth and variable time delay modules for steering the antenna in elevation. In one embodiment of the present invention, the antenna is primarily steerable in a single dimension (e.g, elevation), but includes a degree of back-scanning steering capacity in a second dimension (e.g., azimuth) that is able to compensate for dynamic settling pointing errors.

The RF beam pointing apparatus may operate as noted above to combine mechanical steering with rapid electronic steering during a target tracking sequence. In addition, the RF beam pointing system may initiate a target acquisition mechanical slew maneuver, after which dynamic settling errors are eliminated by handing off operation to the electronic steering technique, or combined electronic and mechanical steering technique.

Numerous additional features, capabilities, and characteristics of the present invention are described below in the detailed description of the invention.

DETAILED DESCRIPTION OF THE INVENTION

Figure 4:
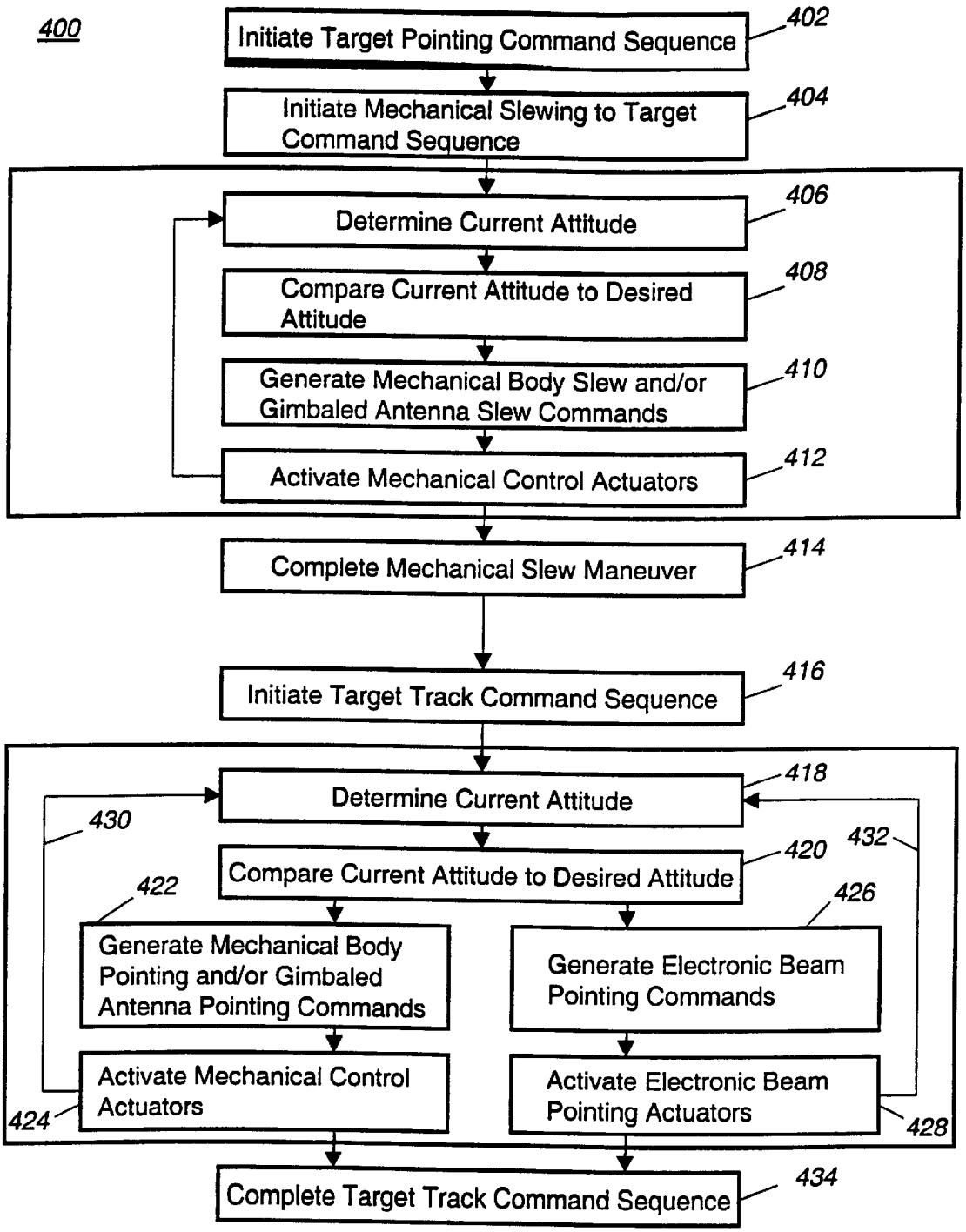
FIG. 4 presents a process/logic flow diagram of a mechanical and electronic feedback controlled beam pointing method.

Turning now to FIG. 4, that figure presents a process/logic flow diagram 400 of a mechanical and electronic feedback controlled beam pointing method. At step 402, the satellite initiates a target pointing command sequence, for example, when the satellite is commanded to image a target. At step 404, the command sequence results in mechanical slewing of the satellite to provide a coarse attitude adjustment of the antenna to acquire the target. The satellite may carry out the mechanical slew using a body slew maneuver that moves the satellite itself (when the antenna is rigidly attached to the satellite), or by activating gimbals on which the antenna is mounted or both.

At step 406, the satellite determines the current attitude of the antenna. As part of this process, the satellite may accept input, for example, from attitude reference sensors (e.g., a star tracker) or input from an inertial reference system. At step 408, the current attitude of the antenna is compared to a desired antenna attitude, and at step 410 additional mechanical slew commands are generated (assuming the target is still outside the range of electronic access FOR) to further adjust the attitude of the satellite and its antenna through, for example, actuation of mechanical control actuators (step 412).

Steps 406–412 are performed in mechanically slewing to the target, using, for example, a low bandwidth feedback control loop. As an example only, the feedback control loop may proceed at approximately 100 Hz. Upon completion of the control loop at step 414, the satellite generally has achieved at least coarse target pointing, but is generally experiencing mechanical slew induced dynamic settling errors (as shown, for example, in FIG. 2).

As noted above in the discussion of SAR systems, the satellite antenna tracks its target during imaging. Thus, at step 416, the satellite initiates a target tracking command sequence. At step 418, the satellite determines the current attitude of the antenna. At step 420, the current attitude of the antenna is compared to a desired antenna attitude, and electronic and mechanical attitude correction may be performed. In particular, for mechanical attitude correction, the satellite at step 422 generates additional mechanical slew commands (executed at step 424) to incrementally adjust the attitude of the satellite and its antenna to track the target.

Electronic attitude correction may proceed initially as noted above, including determining the current antenna attitude (step 418) and comparing to the desired antenna attitude (step 420). With electronic attitude correction, however, the satellite corrects settling and other errors in antenna pointing by generating electronic beam pointing commands at step 426. The electronic beam pointing commands may, for example, set or adjust the phase and amplitude settings of variable time delay modules used to implement a phase array antenna (step 428).

Steps 418–428 are performed during the target tracking process using a dual relatively low bandwidth mechanical feedback control loop 430 and a relatively high bandwidth electronic feedback control loop 432. As examples only, the mechanical feedback control loop 430 may repeat at approximately 100 Hz while the electronic feedback control loop may proceed substantially faster (e.g., at 1000 Hz or more). The rate at which mechanical and electronic control occur is limited only by the technology used to implement the mechanical and electronic control loop. Thus, the above examples do not represent a fundamental limit on the performance of the invention, but are only examples of one possible implementation. Upon completion of target tracking at step 434, the satellite may prepare for additional imaging or communications tasks.

Because electronic beam pointing is typically very accurate, precise, and rapid, the electronic feedback control loop 432 is able to reduce the mechanical slew induced dynamic settling antenna pointing errors to within a predetermined pointing accuracy for nominal operation almost immediately after the mechanical slew completes. Thus, the present invention allows the satellite to effectively use, rather than waste, large amounts of time waiting for settling errors (see FIGS. 2 and 3, for example) to die out. Many diverse types of applications may use the beam pointing method shown in FIG. 4. For example, in addition to radar imaging applications, unidirectional or bi-directional communication satellites may accurately maintain transmit and/or receive antenna alignment using the above described technique.

Figure 5:
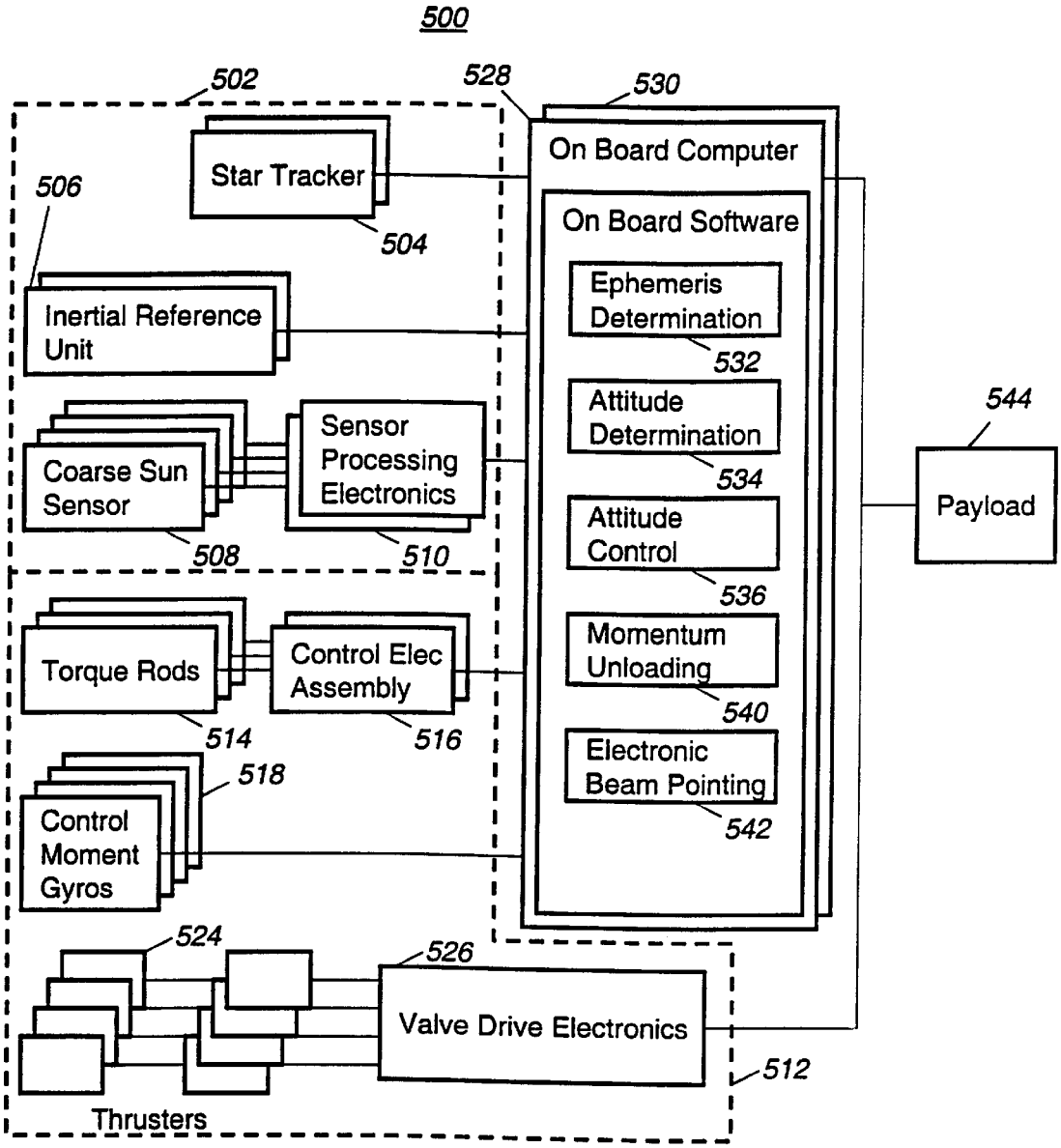
FIG. 5 presents a block diagram of a feedback controlled beam pointing apparatus according to a particular body slewed embodiment of the invention.

Turning next to FIG. 5, that figure shows a block diagram of a feedback controlled beam pointing apparatus 500 according to a particular body slewed embodiment of the invention. FIG. 5 shows attitude reference system components 502, including a star tracker 504, an inertial reference unit 506, and a sun sensor 508 (typically only used in the case of system anomalies) with associated processing electronics 510.

Mechanical attitude control and beam pointing components 512 are also illustrated. The beam pointing components include torque rods 514 with control electronics 516, control moment gyros 518 with electronics 522, and thrusters 524 with valve drive electronics 526. Although reaction wheels, control moment gyros, and thruster based attitude control are most commonly used, alternate attitude control architectures may be used, including, for example, pitch momentum biased systems using momentum wheels.

Primary and redundant on board computers (OBCs) 528, 530 function as control circuitry for the feedback controlled beam pointing apparatus 500. The OBCs execute software modules for ephemeris determination 532, attitude determination 534, attitude control 536, momentum unloading 540, and electronic beam pointing 542.

Also shown in FIG. 5 is a phased array payload antenna assembly 544. The payload assembly 544 may be for example, either a one dimensional or two dimensional phased array antenna, an RF communications or radar assembly, and may be used as a transmit only, receive only, or transmit and receive antenna.

The attitude reference components 502, OBCs 528, 530, and the associated attitude determination software 534 provide the satellite with an attitude reference system that determines the attitude of the satellite and the antenna on the satellite. The attitude determination system preferably uses Kalman filtered sensor and inertial reference unit data to yield an estimate of the spacecraft attitude. In many systems, including body slewed systems, beam pointing direction and the satellite attitude are generally fixed with respect to one another. Thus, the determination of antenna attitude (and beam pointing direction) follows from a determination of satellite attitude.

The attitude control components 512, the OBCs 528, 530, and the associated attitude control software 536 provide the satellite with an attitude control system. Comparison of commanded attitude with estimated attitude is preferably performed by the circuitry of the OBCs 528, 530 through the operation of the attitude control software module 536. The attitude control software module 536 also functions to generate commands that activate the mechanical attitude components 512 thereby causing re-orientation of the satellite to the desired attitude. Differences between actual attitude and commanded attitude are commonly called attitude control errors and are represented internally, for example, by antenna pointing error data signals operated on by the OBCs 528, 530, for example.

The mechanical beam pointing system compares commanded antenna pointing direction with an estimated antenna pointing direction. In a body slewed system, such as the system of FIG. 5, the antenna pointing direction and the satellite attitude are generally fixed with respect to one another, so that the attitude control system also performs the function of mechanical antenna (and beam) pointing.

The phased array payload assembly 544, the OBCs 528, 530, and the associated electronic beam pointing software 542 provide an electronic beam pointing system for the payload assembly 544. As noted above, the payload assembly 544 may be rigidly mounted to the satellite. However, the payload assembly may also be mounted on gimbals, thereby providing a second mechanism for mechanically pointing the antenna.

Figure 6:
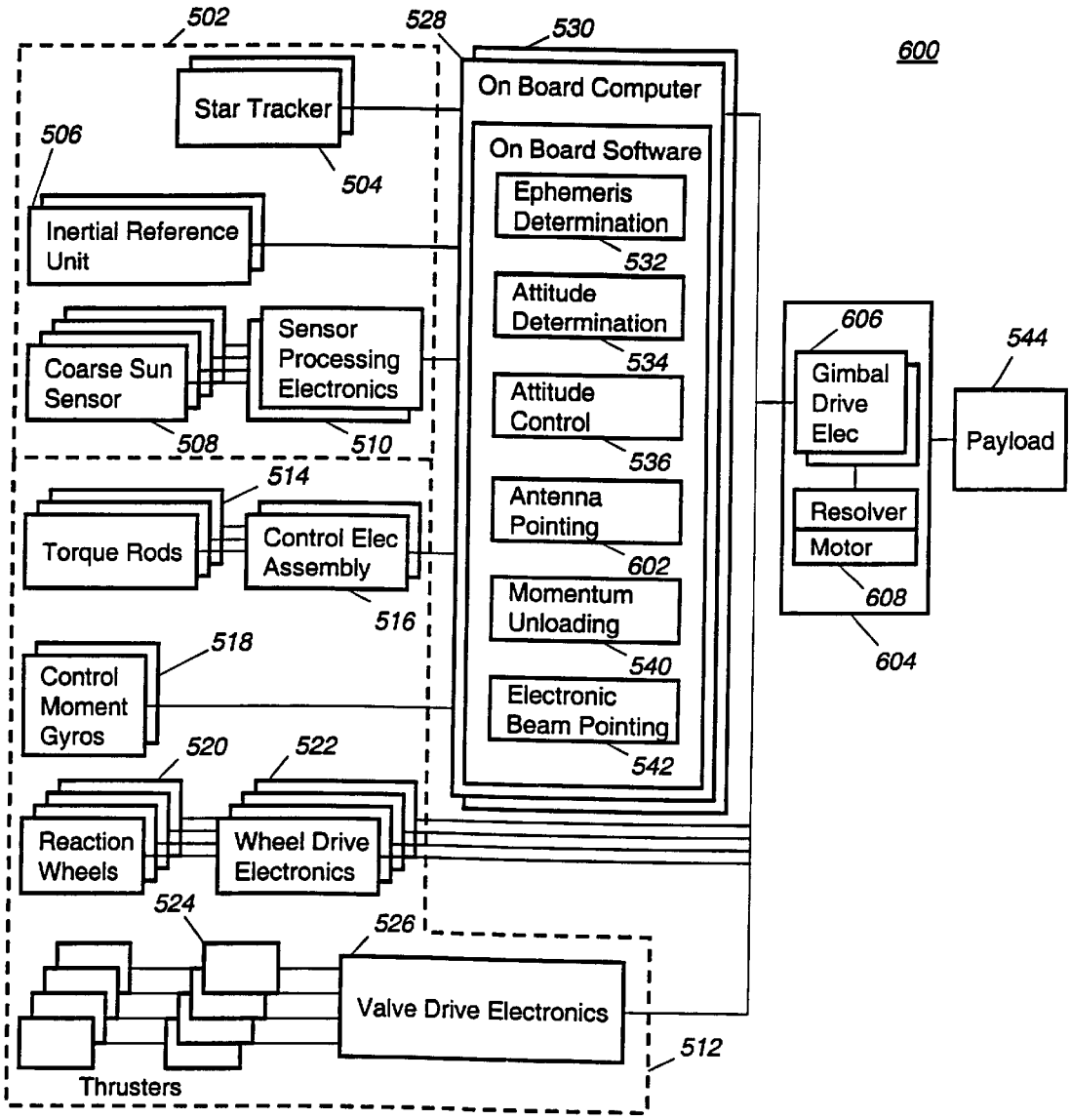
FIG. 6 presents a block diagram of a feedback controlled beam pointing apparatus according to a particular gimbaled embodiment of the invention.

Turning to FIG. 6, that figure shows a block diagram of a feedback controlled beam pointing apparatus 600 according to a gimbaled embodiment of the invention. The majority of the elements of FIG. 6 have been explained above in the discussion of FIG. 5 (and therefore share common reference numerals with FIG. 5). Note in FIG. 6, however, that the OBCs 528, 530 also execute an antenna pointing software module 602 and that the payload 544 rests on a gimbal system 604.

The gimbal system 604 includes a set of gimbal drive electronics 606 and associated motor and resolver 608. The gimbal system 604 operates under the direction of the OBCs 528, 530 and the antenna pointing software module 602 to adjust the attitude of the payload 544 as desired. Note, however, that the gimbal system is a mechanical system, and therefore induces dynamic settling errors in the pointing of the payload 544, just as a satellite body slew maneuver does. In fact, a satellite body slew may be used in conjunction with gimballing during a mechanical attitude adjustment.

The payload assembly 544, as noted above, may be a conventional one dimensional or two dimensional phased array antenna, for example. One possible payload assembly 544 is illustrated schematically in FIG. 7.

Figure 7:
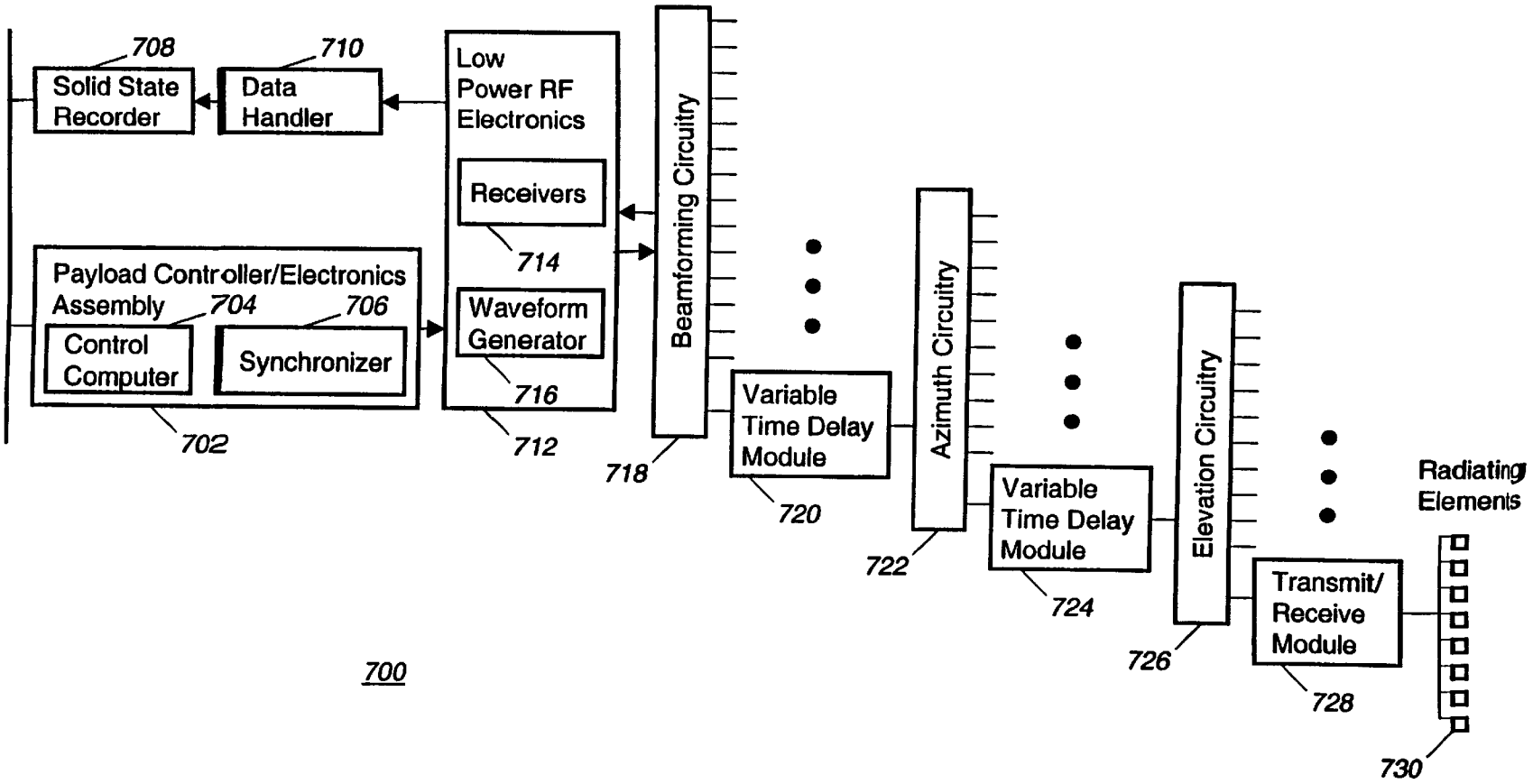
FIG. 7 presents a block diagram of an antenna payload that may be used with the present feedback controlled beam pointing apparatus.

FIG. 7 illustrates a two dimensional phased array synthetic aperture radar 700. The radar 700 shows payload controller circuitry 702 including, for example, a control computer 704 and a data synchronizer 706. Also shown is a solid state recorder 708 and a data handler 710 that are used to capture incoming data. The payload controller circuitry 702 and data handler 710 interface with low power RF electronic circuitry 712 that typically includes receiver circuitry (generally indicated at 714) and a waveform generator (generally indicated at 716).

FIG. 7 also shows the hardware elements from which the antenna itself is constructed. In particular, beamforming circuitry 718 is coupled, typically, to numerous azimuth steering variable time delay modules 720. In turn, the azimuth steering variable time delay modules 720 are coupled to azimuth beamforming circuitry 722, which is in turn followed by numerous elevation variable delay time delay modules 724 and elevation beamforming circuitry 726. Transmit/receive modules 728 couple the elevation beamforming cuitry 726 to the radiating elements 730. Although the structure shown in FIG. 7 is generally suitable for two dimensional transmit and receive operation, the present invention may find application as well to transmit only, receive only, transmit/receive, and one or two dimensional phased array antennas.

The electronic beam pointing system 500 compares commanded antenna pointing direction with an estimated antenna pointing direction using, for example, the electronic beam pointing software 542, which generates beam steering commands for control of the payload assembly 544. The control computer 704 (typically a separate computer from the OBCs 528, 530) may process the beam steering commands and directly control the variable time delay modules 720, 724 to steer the antenna.

During operation, the satellite may be required to image many targets. To point the beam at these targets, the mechanical beam pointing system 512 operates as explained above with respect to FIG. 4. After the satellite mechanically points the antenna, pointing control errors are induced by effects including, as examples, jitter, rigid body dynamic imbalance, software algorithm limitations, and limitations on mechanical bearing pointing accuracy.

Figure 8:
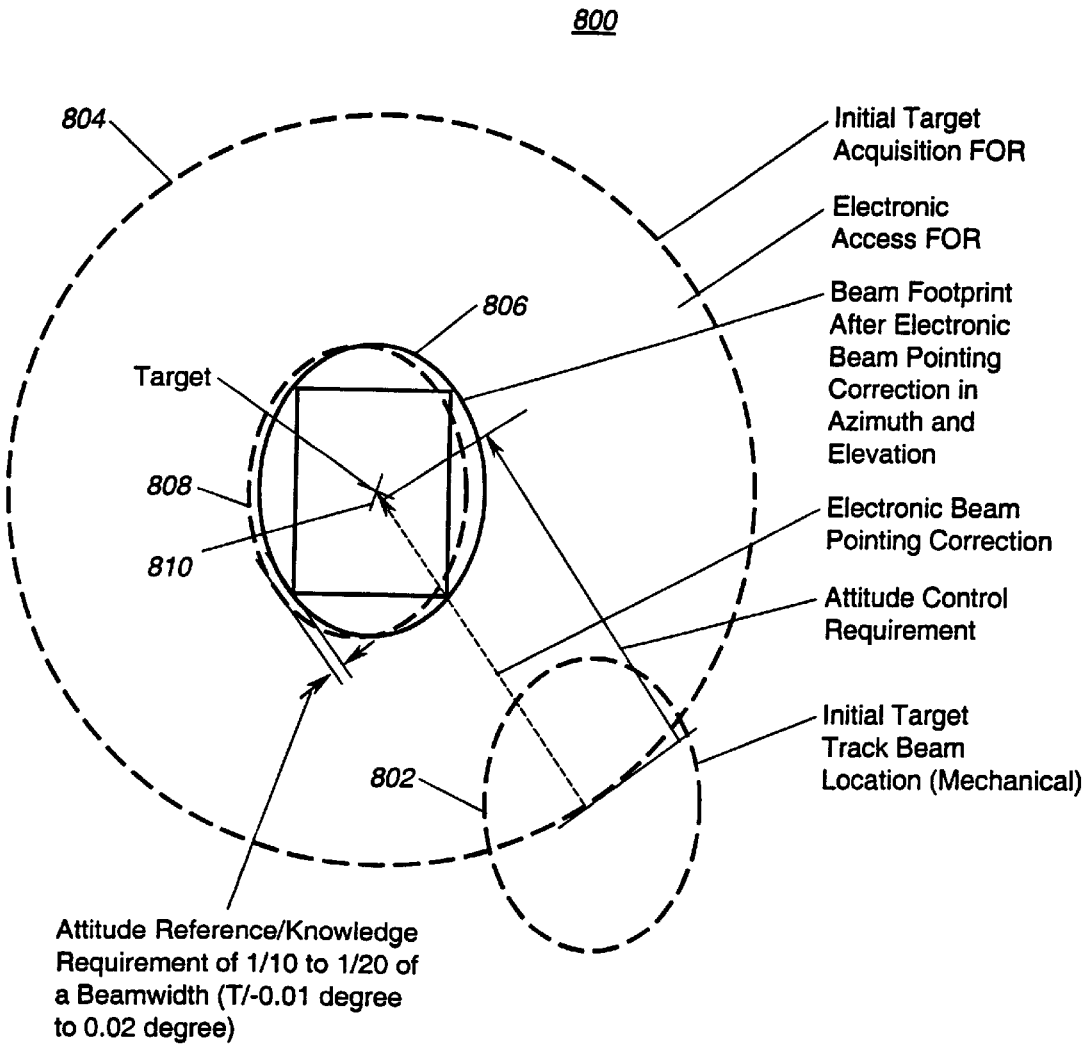
FIG. 8 illustrates the results of antenna attitude control using electronic pointing to correct for mechanical pointing errors.

The illustrated invention couples the coarse mechanical beam pointing system with a narrow angle electronic beam pointing system. Electronic beam pointing corrects for the initial pointing errors in the mechanical pointing system. An example is illustrated in FIG. 8 which shows a view 800 of a terrestrial target 810 to be imaged. The relative motion of a LEO SAR imaging satellite with respect to the earth is primarily in the azimuth direction. Therefore, electronic pointing of the beam will need to occur in the azimuth direction to counter the effects of this relative motion and enable the satellite to dwell on a particular target for the desired or necessary time frame. The dwell time on a particular target depends, of course, on the desired resolution and the imaging area. For example, for LEO phased array radar systems with narrow beam angles, desired dwelling times may range from less than ten seconds up to one minute.

With mechanical beam pointing, the initial RF beam pointing location 802 (as a result of initial target acquisition, for example) in the FOR 804 centered around the target 810 may be a significant distance from the desired pointing location 806 and may undergo shifting during the after-slew settling times. The pointing accuracy for nominal operation (e.g., 0.01 degree–0.02 degree) is shown as a shifted location 808.

Figure 1:
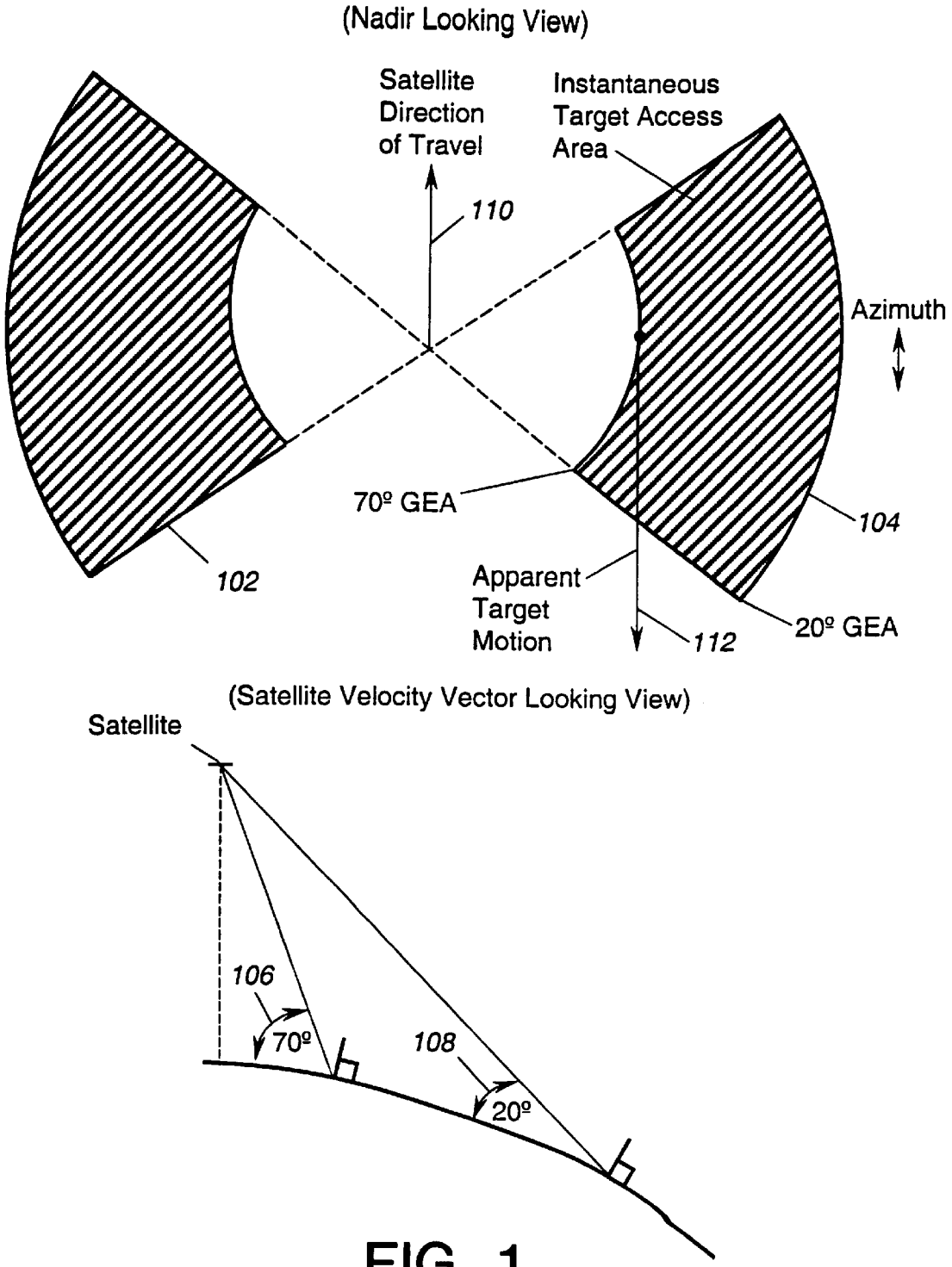
FIG. 1 presents typical target access constraints for a synthetic aperture radar imaging system.
Figure 2:
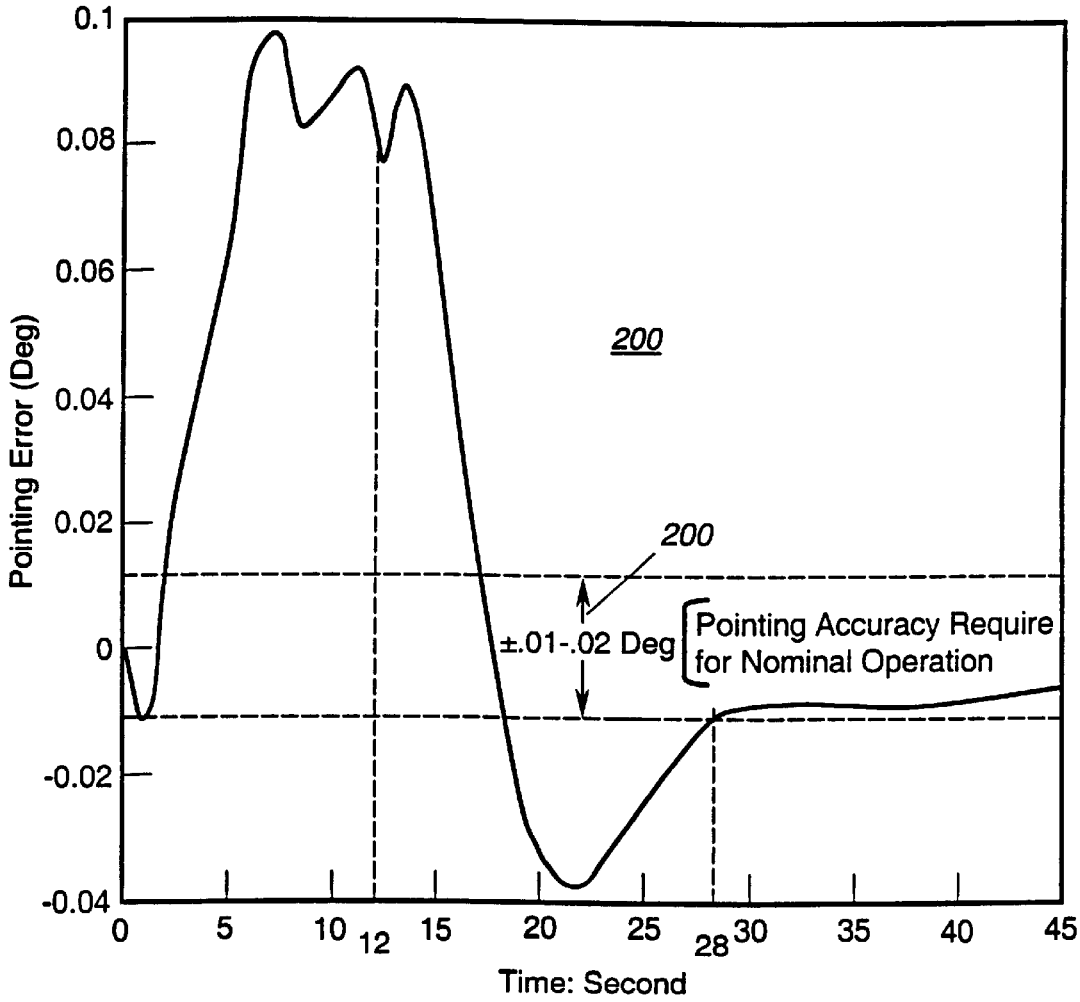
FIG. 2 presents a graph showing the position error profile for a simulation of a beam pointing system using only mechanical beam pointing with a body fixed radar.
Figure 3:
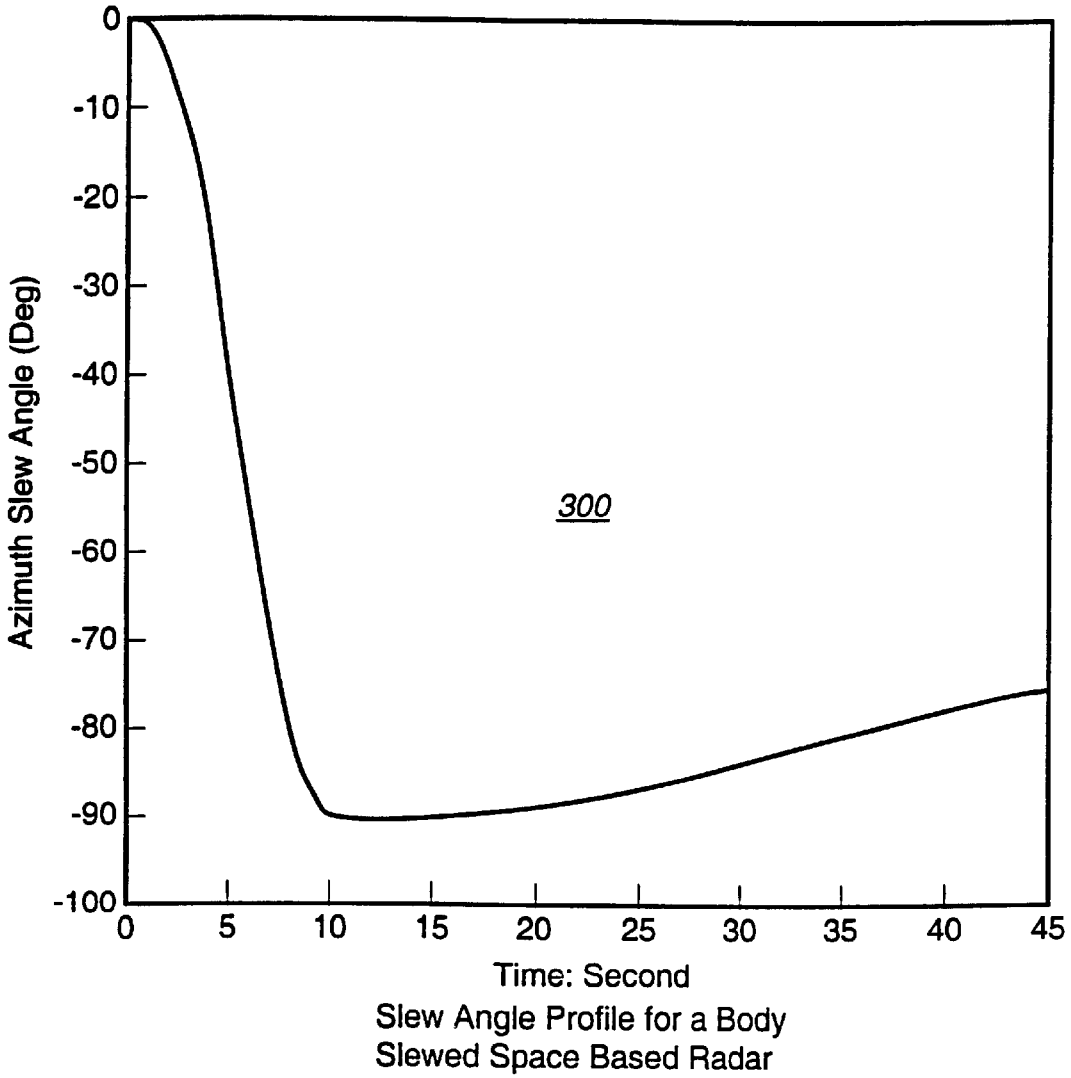
FIG. 3 presents a graph showing the slew angle profile of the simulation of a body slewed mechanical beam pointing system.

The electronic beam pointing technique of the present invention corrects for the inherent mechanical pointing errors and may be used to immediately correct the initial beam pointing location 802 to the desired pointing location 806. The electronic beam angular pointing range may be made very narrow, covering only the angular region required to make up for the initial pointing errors. For example, as shown in FIG. 2, the angular region may be as small as 0.1 degree. Such an angular region may be covered by the backscanning capabilities of a SAR phased array antenna radar system that primarily uses mechanical slew for azimuth control and electronic steering for elevation control, but which allows a small amount of electronic steering in azimuth. Such a system may be implemented using known phased array antenna theory.

The result is very modest steering requirements on the phased array, thereby reducing the number of variable time delay or TR modules as well as the system complexity from a broad angle two dimensional phased array system. The electronic beam pointing bandwidth is preferably substantially greater than the mechanical pointing bandwidth, to compensate for the control errors. In the case of a SAR, this system virtually eliminates the need to wait for dynamic settling before imaging can occur, substantially reducing the overall time per image and increasing the number of targets or target region.

With regard to the simulation shown in FIG. 2, for example, the present invention allows accurate imaging of targets for at least an extra 16 seconds after a mechanical slew. In other words, the electronic steering feedback loop 432 discussed above allows the satellite to begin imaging immediately after the slew completes (at time t=12) rather than waiting until the dynamic settling errors die out (at time t=28). The extra imaging time may be used to image additional targets, or to obtain enhanced images of a single target, for example.

In addition to compensating for the initial pointing errors due to settling after a mechanical slew, the present invention may also be used to reduce the pointing requirements on the overall mechanical system, greatly alleviating the complexity and cost of the mechanical system. Precision gimbal mechanisms, stiff structures, and jitter suppression systems may be very expensive, particularly those used with relatively high mass on gimbal assemblies, such as large phased arrays.

As noted above, the illustrated embodiment may also be used with RF phased array communication systems. Limited time duration communication is common for both intersatellite make/break link operations and terrestrial communication from LEO satellites. Combining mechanical and electrical beam pointing provides the advantages of reducing link acquisition times and optimally allocates the pointing requirements across the mechanical and electronic elements, thereby reducing the overall system cost.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A method for compensating for the effects of settling errors on antenna pointing, the method comprising:

performing a mechanical slew on a satellite carrying an antenna electronically steerable in at least one dimension;

in response to dynamic settling antenna pointing errors resulting from the mechanical slew, performing electronic attitude correction by:

determining an antenna attitude from a current satellite attitude using a satellite attitude reference system;

comparing the current antenna attitude to a desired antenna attitude, and electronically steering the antenna toward the desired antenna attitude to reduce the dynamic settling induced antenna pointing errors to within a predetermined pointing accuracy for nominal operation.

2. The method of claim 1 wherein the step of performing a mechanical slew comprises gimballing the antenna.

3. The method of claim 1, wherein the electronic attitude correction step occurs during a target tracking sequence, and further comprising performing mechanical attitude correction during the target tracking sequence by:

determining the antenna attitude from the current satellite attitude using the satellite attitude reference system;

comparing the current antenna attitude to the desired antenna attitude, and mechanically steering the antenna toward the desired antenna attitude.

4. The method of claim 3, wherein the step of performing electronic attitude correction repeats at a first rate, the step of performing mechanical attitude correction repeats at a second rate, and wherein the first rate is greater than the second rate.

5. The method of claim 4, wherein the first rate is substantially greater than the second rate.

6. The method of claim 1, wherein the step of electronically steering comprises adjusting at least one variable time delay module associated with transmit receive beam steering of the antenna.

7. The method of claim 6, wherein the step of electronically steering comprises adjusting at least one variable time delay module associated with communications transmit receive beam steering of the antenna.

8. The method of claim 1, wherein the step of electronically steering comprises adjusting at least one variable time delay module associated with transmit and receive beam steering of the antenna.

9. The method of claim 8, wherein the step of electronically steering comprises adjusting at least one variable time delay module associated with one of RADAR and communications transmit and receive beam steering of the antenna.

10. The method of claim 1, wherein the step of performing electronic attitude correction continues after the dynamic settling induced antenna pointing errors fall below the predetermined pointing accuracy for nominal operation.

11. The method of claim 1, wherein the step of performing a mechanical slew comprises performing an initial target acquisition pointing mechanical slew.

12. The method of claim 11, wherein the step of performing electronic attitude correction occurs after the initial target pointing mechanical slew and during a target tracking sequence.

13. An RF beam pointing apparatus for compensating for the effects of settling errors on antenna pointing, the beam pointing apparatus comprising:

a satellite attitude reference system generating an antenna attitude output based on a current satellite attitude, the antenna attitude output representative of an attitude of an antenna electronically steerable in at least one dimension;

attitude comparison circuitry, coupled to the attitude reference system;

control circuitry, coupled to the attitude reference system and the attitude comparison circuitry, the control circuitry directing the attitude comparison circuitry to generate attitude control error output signals in response to dynamic settling antenna pointing errors induced by a mechanical slew on the satellite; and an electronic beam pointing system coupled to the control circuitry and to the antenna for steering the antenna in response to the attitude control error output signals to reduce the dynamic settling antenna pointing errors to within a predetermined pointing accuracy for nominal operation.

14. The beam pointing apparatus of claim 13 further including a satellite on-board computer comprising the control circuitry.

15. The beam pointing apparatus of claim 14, wherein the attitude reference system accepts input from one of a star tracker, a sun sensor and an inertial reference unit.

16. The beam pointing apparatus of claim 13 wherein the antenna is a transmit antenna.

17. The beam pointing apparatus of claim 13, wherein the antenna is a transmit and receive antenna.

18. The beam pointing apparatus of claim 15, wherein the transmit and receive antenna is one of a communications and a RADAR antenna.

19. The beam pointing apparatus of claim 13, wherein the electronic beam pointing system comprises at least one variable time delay module for steering the antenna in azimuth.

20. The beam pointing apparatus of claim 13, wherein the electronic beam pointing system comprises at least one variable time delay module for steering the antenna in elevation.

21. The beam pointing apparatus of claim 13, further comprising a mechanical beam pointing system for steering the antenna toward a desired antenna attitude, and wherein the mechanical beam pointing system comprises gimbals for mechanically pointing the antenna.

22. The beam pointing apparatus of claim 21, wherein the mechanical beam pointing system comprises at least one of torque rods, reaction wheels, thrusters, momentum wheels, and control moment gyros for mechanically pointing the satellite.

23. The beam pointing apparatus of claim 21, wherein the mechanical beam pointing system performs an initial target pointing mechanical slew that generates at least a portion of the dynamic settling induced antenna pointing errors.

24. A satellite providing enhanced antenna pointing capabilities, the satellite comprising:

an antenna electronically steerable in at least one dimension;

a mechanical beam pointing system;

a satellite attitude reference system generating an antenna attitude output based on a current satellite attitude;

attitude comparison circuitry, coupled to the attitude reference system;

control circuitry, coupled to the attitude reference system and the attitude comparison circuitry, the control circuitry directing the attitude comparison circuitry to generate control error output signals in response to dynamic settling induced antenna pointing errors induced by a mechanical slew on the satellite; and an electronic beam pointing system coupled to the attitude comparison circuitry and to the antenna for steering the antenna in response to the antenna pointing error signals to reduce the dynamic settling induced antenna pointing errors to within a predetermined pointing accuracy for nominal operation.

25. The satellite of claim 24, wherein the mechanical beam pointing system is a satellite body slewing system.

26. The satellite of claim 24, wherein the mechanical beam pointing system comprises antenna mounted gimbals.

27. The satellite of claim 24, wherein the control circuitry initiates a target tracking sequence wherein the mechanical beam pointing system operates at a first rate to steer the antenna to a desired antenna attitude and wherein the electronic beam pointing system operates at a second rate to reduce the dynamic settling induced antenna pointing errors.

28. The satellite of claim 27, wherein the second rate is substantially faster than the first rate.

* * * * *